United States Patent [19]

Carson

[11] Patent Number: 5,022,545

[45] Date of Patent: Jun. 11, 1991

[54] TAMPER EVIDENT CLOSURE

[75] Inventor: Daniel M. Carson, Danbury, Conn.

[73] Assignee: Continental White Cap, Inc., Northbrook, Ill.

[21] Appl. No.: 562,551

[22] Filed: Aug. 3, 1990

[51] Int. Cl.[5] ..... B65D 55/02

[52] U.S. Cl. ..... 215/230

[58] Field of Search ..... 215/230, 262, 270, 271, 215/203, 318

[56] References Cited

U.S. PATENT DOCUMENTS

| | | | |
|---|---|---|---|
| 1,808,702 | 6/1931 | Williams | 215/262 X |
| 3,736,899 | 6/1973 | Manske | 215/230 X |
| 4,051,973 | 10/1977 | Botkin | 215/260 |
| 4,480,760 | 11/1984 | Schonberger | 215/230 |
| 4,489,841 | 12/1984 | Thompson | 215/203 |
| 4,519,515 | 5/1985 | Schonberger | 215/230 |
| 4,747,497 | 5/1988 | Holman | 215/230 |
| 4,765,498 | 8/1988 | Rafferty | 215/230 |
| 4,905,851 | 3/1990 | Thompson | 215/203 |

*Primary Examiner*—Gary E. Elkins
*Assistant Examiner*—Vanessa M. Roberts
*Attorney, Agent, or Firm*—Lockwood, Alex, FitzGibbon & Cummings

[57] ABSTRACT

This relates to an improvement of a conventional closure having a tamper evident feature in the form of a safety button. In accordance with the improvement, the surface of the safety button is provided with a coating in the form of a suitable binder incorporating rupturable microcapsules containing an FDA approved colorant. A relatively stiff layer of translucent material overlies an end panel of the closure in position to be engaged by the microcapsules and to effect rupture of the microcapsules when the safety button everts from a lower axial position to an upper axial position and the microcapsules strike against the underside of the layer of translucent material. In order to prevent accidental rupture of the microcapsules prior to the closure being applied to a container, there is incorporated in the coating spacers which normally prevent the rupture of the microcapsules during conditions of manufacture and handling. The colorant carried by the microcapsules will give a clear and irreversible indication of the opening of the container.

8 Claims, 1 Drawing Sheet

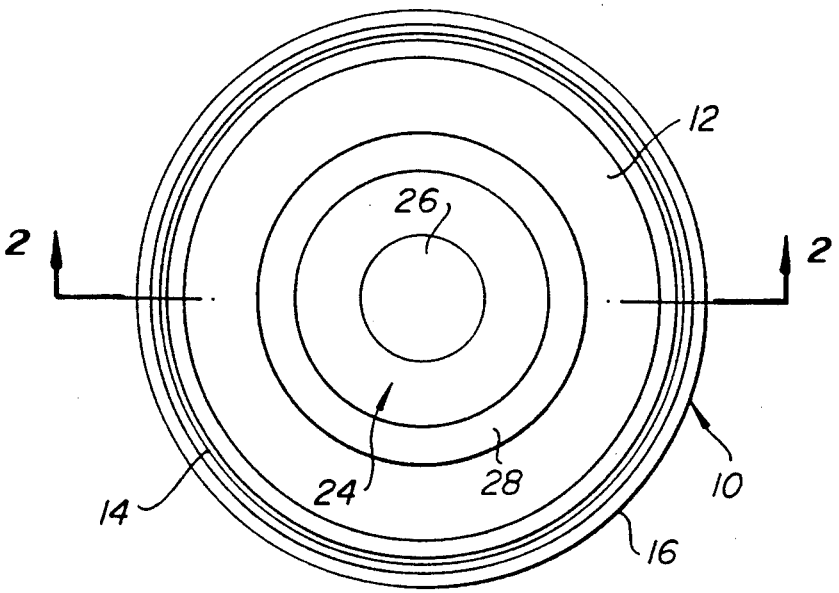
FIG. 1
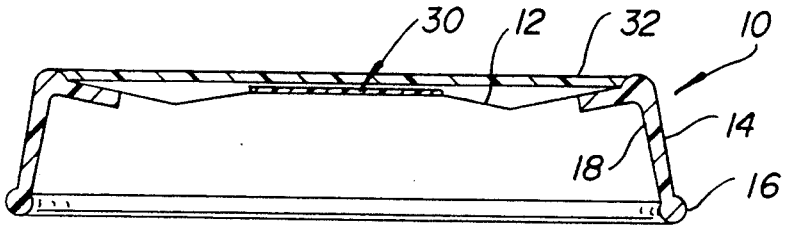
FIG. 2
FIG. 3
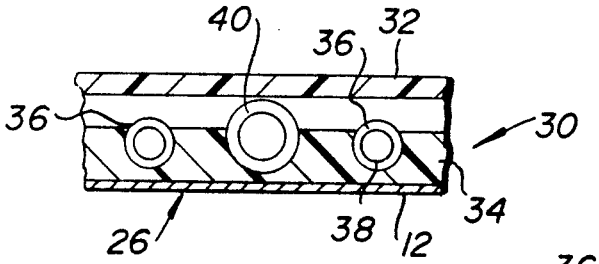
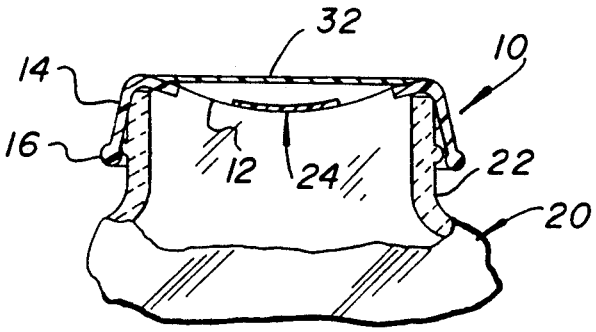
FIG. 5
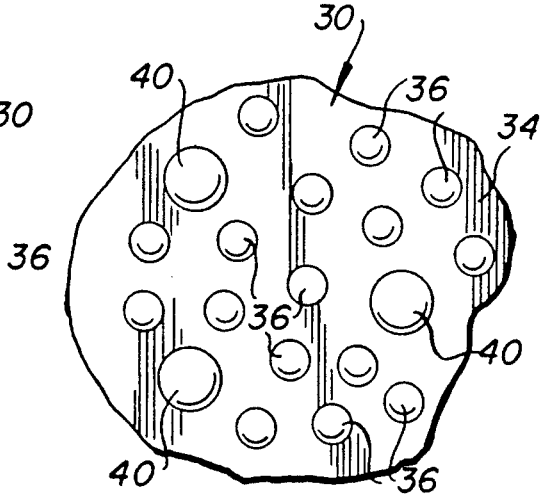
FIG. 4

TAMPER EVIDENT CLOSURE

This invention relates in general to new and useful improvements in tamper evident closures which utilize a safety button, and more particularly to a tamper evident closure wherein the safety button is provided with tamper indicating means employing a colorant.

BACKGROUND OF THE INVENTION

The use of a safety button is a well known means of providing tamper evidence. However, one of the concerns with the button feature is the ability of one to overcome it. For example, a vacuum packed container closed by a closure provided with a safety button may be opened, the product tampered with, and the closure reapplied under vacuum conditions. In such event, the button will be in its downwardly drawn position and will fail to give evidence that the container has been opened.

Another deficiency of closures provided solely with safety buttons is that frequently users do not note the condition of the safety button.

SUMMARY OF THE INVENTION

The purpose of this invention is to enhance the performance of the safety button to both make it more obvious and to make its function irreversable. In accordance with this invention, a suitable coating is applied to the button area of the closure, after which a translucent panel is applied to the closure generally at its periphery. The coating is applied with a plurality of microcapsules each containing a suitable colorant such as an FDA approved dye or colorant. The translucent material is relatively stiff and as a result, when the button reverses its position upon the loss of a vacuum, the microcapsules strike the translucent panel and rupture, permitting the colorant contained therein to flow outwardly and to stain either the surface of the coating material or the underside of the translucent material.

The problem with this particular arrangement is that initially the coating material containing the microcapsules is closely adjacent the layer of translucent material and in the handling of the closures prior to the production of a vacuum within an associated container, the microcapsules may be accidently ruptured. In view of this, it is another feature of this invention to incorporate in the coating spacers which project above the microcapsules and prevent accidental rupture of the microcapsules. The spacers, however, do not protrude sufficiently above the microcapsules so as to prevent the microcapsules striking the layer of translucent material when the safety button snaps back to and generally beyond its original position to effect rupture of the microcapsules.

With the above and other objects in view that will hereinafter appear, the nature of the invention will be more clearly understood by reference to the following detailed description, the appended claims, and the several views illustrated in the accompanying drawings.

FIG. 1 is a top plan view of a conventional prior art tamper evident closure incorporating a conventional safety button.

FIG. 2 is an enlarged transverse vertical sectional view taken generally along the line 2—2 of FIG. 1 showing the conventional tamper evident closure modified in accordance with this invention.

FIG. 3 is an enlarged fragmentary vertical sectional view taken through a central part of the button area of the closure and shows the arrangement of the tamper evident coating, including spacers, provided in accordance with this invention.

FIG. 4 is a plan view of the central part of the safety button and shows the general arrangement of colorant carrying microcapsules and spacers.

FIG. 5 is a schematic sectional view taken through a vacuum packed container incorporating the closure of this invention and showing the button in its vacuum retracted or everted position.

Referring now to the drawings in detail, reference is first made to FIGS. 1 and 2 wherein there is illustrated a conventional tamper evident closure incorporating a safety button, the closure being generally identified by the numeral 10. The closure 10 is preferably formed of metal. The closure 10 basically includes an end panel 12 to which there is integrally connected a skirt 14 which terminates at its lower edge in a curl 16. The skirt 14 and a peripheral part of the end panel 12 are provided with a suitable coating of sealing compound 18.

The illustrated closure 10 is generally of the press-on, twist-off type and is intended to be engaged with a container, such as the container of FIG. 5 which is identified by the numeral 20. The container 20 includes a neck finish 22 which is provided with suitable threads (not shown). When the closure 10 is pressed on to the container 20, the sealing compound 18 carried by the skirt 14 will flow around the threads of the container neck finish 22 and interlock therewith. At the same time, that portion of the sealing compound 18 carried by the end panel 12 will engage the end of the neck finish 22 and form a seal therewith.

The closure 10 has the end panel 12 thereof so formed so as to define a tamper evident button generally identified by the numeral 24. The button 24 is circular in outline and includes a center 26. The button 24 is surrounded by an annulus 28 which everts when a vacuum is drawn within the container 20 and applied against the underside of the end panel 12. This will result in the button 24 snapping down generally into the interior of the mouth of the container 20. When the vacuum within the container 20 is lost, the resiliency of the annulus 28 will cause the button 24 to again evert and snap upwardly.

The closure 10, as thus described, has been in commercial use for some time.

In accordance with this invention, at least the circular part 26 of the button 24 is provided with a suitable coating generally identified by the numeral 30 and illustrated in FIG. 2. Further, the closure is provided with a layer 32 of translucent material. The layer 32 is preferably formed of a relatively stiff plastic and is bonded to the outer periphery of the end panel 12 as shown in FIG. 2.

Referring now to FIGS. 3 and 4, it will be seen that the coating 30 includes a suitable binder 34 which is preferably of a plastic material and which bonds to the upper surface of the end panel 12 as shown in FIG. 3. incorporated within the binder 34 is a plurality of microcapsules 36 which are preferably in the form of microcrystals which are hollow and which has incorporated therein a suitable colorant 38. The colorant 38 is preferably in the form of an FDA dye or coloring material.

In accordance with this invention the layer 32 is sufficiently resilient so that when the button 24 is in its down position as effected by a vacuum within the container 20 and as shown in FIG. 5, and the vacuum is released, the button 24 will snap upwardly due to the everting of the annulus 28 and cause a firm striking of the microcapsules 36 against the underside of the layer 32 with sufficient force to effect rupture of the microcapsules and the release of the colorant 38. The released colorant 38 will either effect a change in color of the binder 34 or the underside of the layer 32 so as to provide a visual indication of prior opening of the container 20.

It is to be understood that there is a certain degree of handling of the modified closure 10 after it has been formed and before it is placed on the container 20. In view of this, there is a good probability of at least some of the microcapsules 36 being ruptured prior to the closure 10 being applied to the container 20. Therefore, in accordance with this invention, in addition to the microcapsules 36 being distributed within the matrix 34, there is also distributed in the binder 34 among the microcapsules 36 suitable spacers 40. The spacers 40 are preferably in the form of spheres which are of a slightly larger diameter than the diameter of the microcapsules 36 although the relative sizes have been shown out of proportion in the drawing. The spacers 40 may be suitably formed of a plastic material although other materials are envisioned.

The spacers 40 extend above the microcapsules 36 sufficiently so as to prevent the layer 32 of translucent material from being Pushed down relative to the closure 10 to effect accidental rupture of the microcapsules 36. On the other hand, it is to be understood that when the button 24 has been drawn down into the mouth of the container 20 due to the vacuum produced within the container 20, and then the button 24 snaps upwardly, the spacers 40 will dent the underside of the layer 32 sufficiently to permit the microcapsules 36 to strike the underside of the layer 32 and effect rupture thereof.

As previously described, when rupture of the microcapsules 36 is effected, a suitable colorant 38 will be released and this colorant will serve to stain either the surface of the matrix 34 or the underside of the layer 32 or both. The colorant may be selected so as to readily visible.

Although only a preferred embodiment of the tamper evident means has been specifically illustrated and described herein, it is to be understood that minor variations may be made in the construction of the tamper evident closure without departing from the spirit and scope of the invention as defined by the appended claims.

I claim:

1. A tamper evident closure comprising a closure including an end panel having incorporated therein a tamper indicating button, an external coating on said button including rupturable capsules containing a colorant, said closure being improved by a layer of translucent material carried by said end panel and overlying said button, said translucent layer forming a wall against which said button will effect striking of said capsules to effect rupture of said capsules, and there being scattered among said capsules spacers of a greater height than said capsules for preventing accidental rupture of said capsules.

2. A tamper evident closure according to claim 1 wherein said spacers are incorporated in said coating.

3. A tamper evident closure according to claim 1 wherein said capsules are in the form of microcapsules.

4. A tamper evident closure according to claim 1 wherein said coating and said layer of translucent material are incorporated in said closure prior to application of said closure to a container.

5. A tamper evident closure according to claim 1 wherein said button is a vacuum actuated botton.

6. A tamper evident closure according to claim 1 wherein said button is a vacuum actuated button having a snap action movement between a vacuum held recessed position and a normal elevated position.

7. A tamper evident closure according to claim 1 wherein said colorant is an FDA approved colorant.

8. A tamper evident closure according to claim 1 wherein said colorant is an FDA approved colorant in the form of a liquid dye.

* * * * *